US011986109B2

(12) United States Patent
McLane et al.

(10) Patent No.: US 11,986,109 B2
(45) Date of Patent: May 21, 2024

(54) CAKE PROTECTOR ASSEMBLY AND KIT

(71) Applicants: Brian McLane, Wabash, IN (US); Melva McLane, Wabash, IN (US)

(72) Inventors: Brian McLane, Wabash, IN (US); Melva McLane, Wabash, IN (US)

( * ) Notice: Subject to any disclaimer, the term of this patent is extended or adjusted under 35 U.S.C. 154(b) by 973 days.

(21) Appl. No.: 16/935,332

(22) Filed: Jul. 22, 2020

(65) Prior Publication Data

US 2022/0022673 A1 Jan. 27, 2022

(51) Int. Cl.
*A47G 19/26* (2006.01)

(52) U.S. Cl.
CPC ..... *A47G 19/26* (2013.01); *A47G 2400/061* (2013.01)

(58) Field of Classification Search
None
See application file for complete search history.

(56) References Cited

U.S. PATENT DOCUMENTS 4,145,827 A * 3/1979 Katsufrakis ..... G09F 1/12 40/152
5,226,571 A * 7/1993 Eastwood et al. ..... B26F 3/02 225/49
7,624,887 B2 * 12/2009 Avery ..... 220/9.2
2013/0284865 A1 * 10/2013 Tewkesbury ..... A47B 95/00 248/176.1
2019/0082870 A1 * 3/2019 Kaupp ..... A47G 19/26
2019/0090673 A1 * 3/2019 Radcliffe et al. ..... A47G 23/06

FOREIGN PATENT DOCUMENTS

CN 209915549 U * 1/2020 ..... A47F 5/00

OTHER PUBLICATIONS

Machine translation of CN 209915549 U performed on Aug. 1, 2023, Huang (Year: 2020).*

* cited by examiner

*Primary Examiner* — Dana Ross
*Assistant Examiner* — Kevin Guanhua Wen
(74) *Attorney, Agent, or Firm* — David E. Novak; Brannon Sowers & Cracraft PC

(57) ABSTRACT

A kit for constructing a cake-protecting assembly, including at least two first elongated frame members, at least two second elongated frame members connectable to the pair of first elongated frame members to yield a frame defining a working plane, at least two leg members pivotably connected to each respective elongated first frame member, and at least two elongated stabilizing members connectable to extend orthogonally from a leg member connected to each respective elongated support member and oriented parallel to the working plane. The kit also includes four pegs connectible to the elongated first frame members for limiting the movement of each respective leg member.

7 Claims, 8 Drawing Sheets

CAKE PROTECTOR ASSEMBLY AND KIT

TECHNICAL FIELD OF THE INVENTION

The present invention relates generally to mechanical arts, and, more particularly, to an adjustable cover for supporting enclosing and protecting a cake.

BACKGROUND OF THE INVENTION

While good hygiene has always been important, the current environment underscores the criticality of positive efforts to halt the spread of infectious diseases. One example of unnecessary risk is the breath contamination of a cake in a party situation. Cakes tend to be the centerpiece of celebrations, such as birthdays, anniversaries, retirement parties, and the like, and as such are often in direct communication with the exhalations of a number of people.

While cake-covers exist, they are typically bulky and difficult to store between uses, and are thus not always readily available for use when wanted. Thus, there remains a need for an improved cake guard that may be easily stored between uses and easily deployed when desired. The present invention addresses this need.

DETAILED DESCRIPTION OF THE PREFERRED EMBODIMENTS

Figure 1:
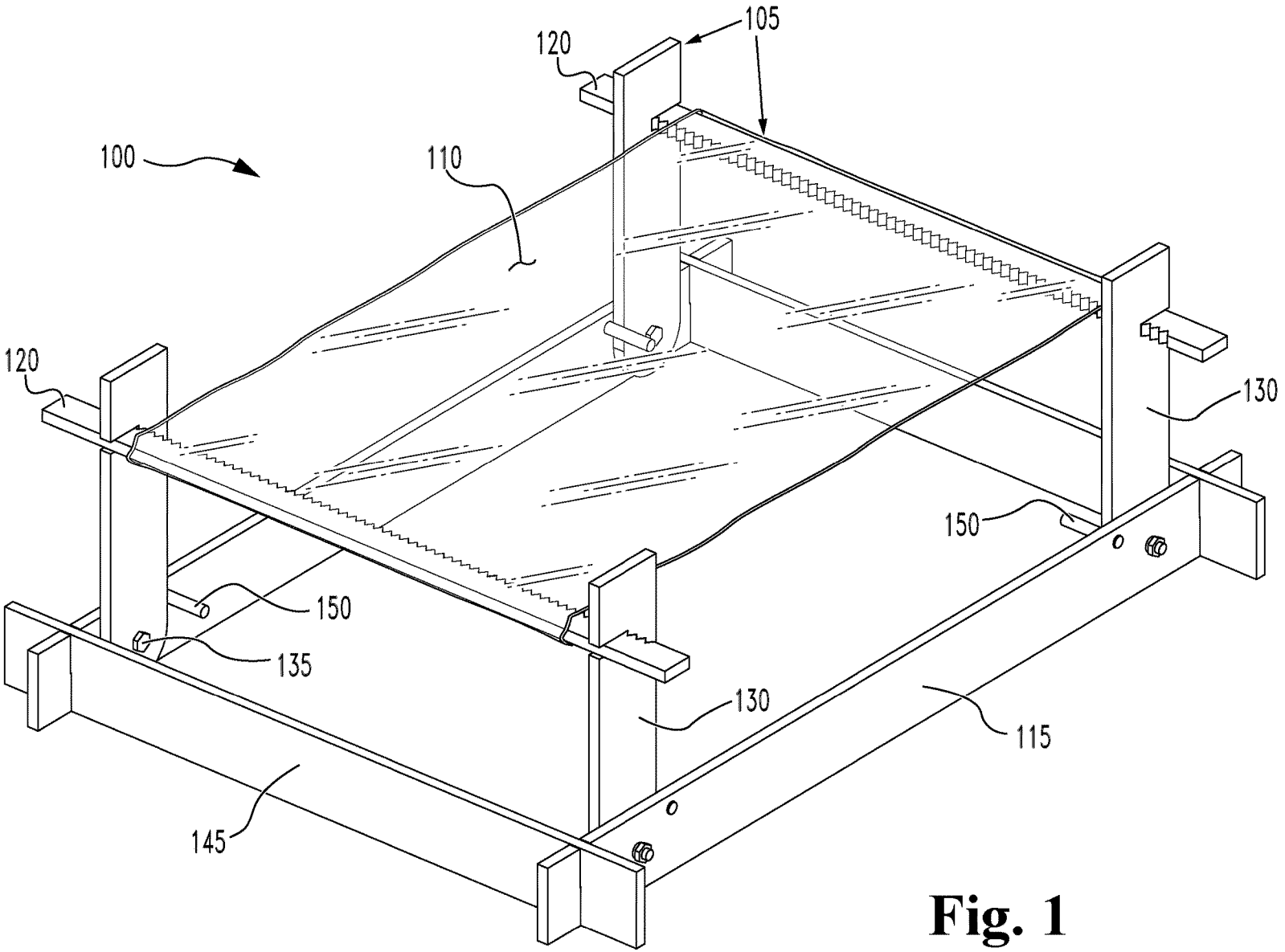
FIG. 1 is a first front perspective view of a first embodiment cake protector assembly of the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
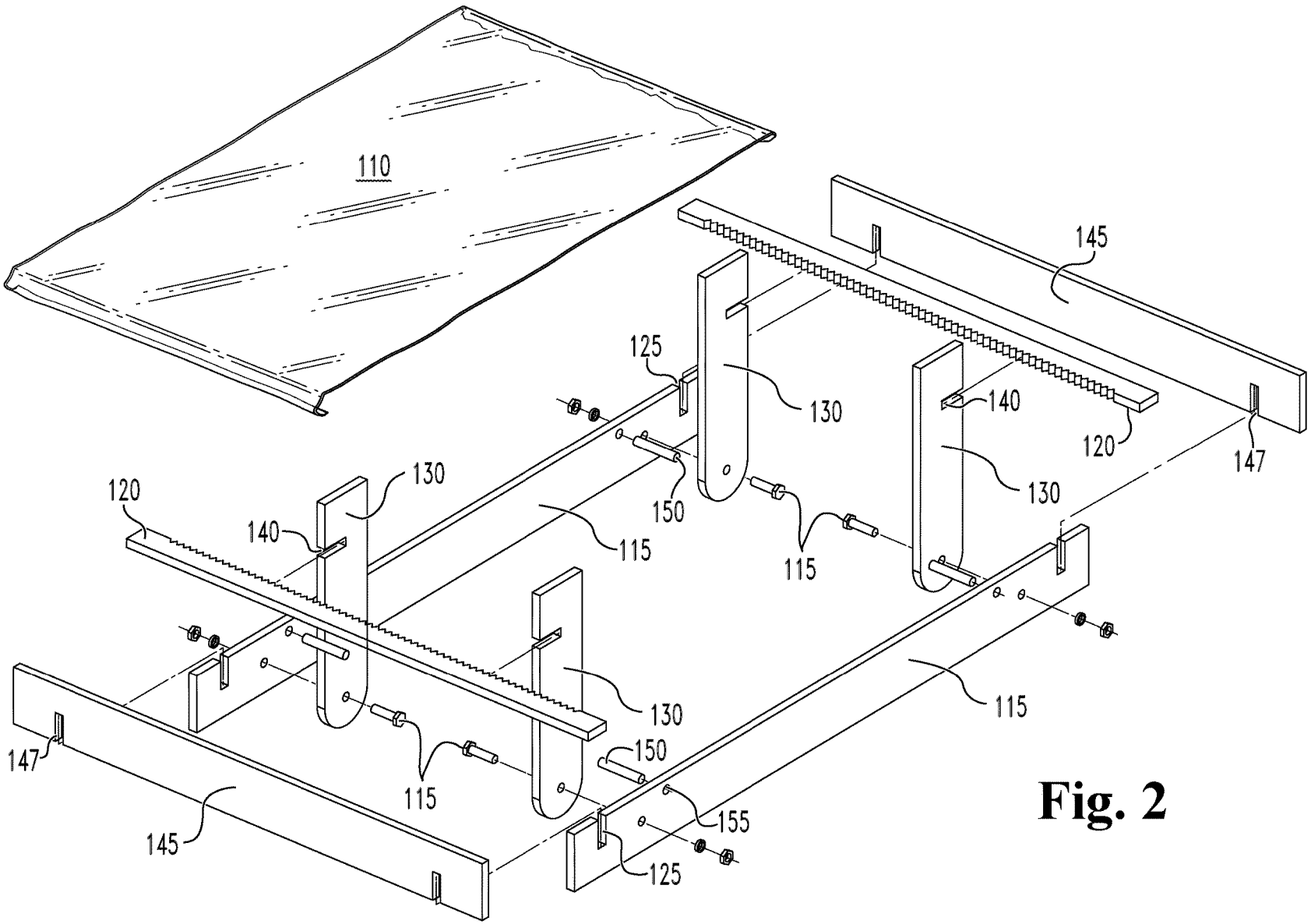
FIG. 2 is a second, exploded front perspective view of the embodiment of FIG. 1.
Figure 3:
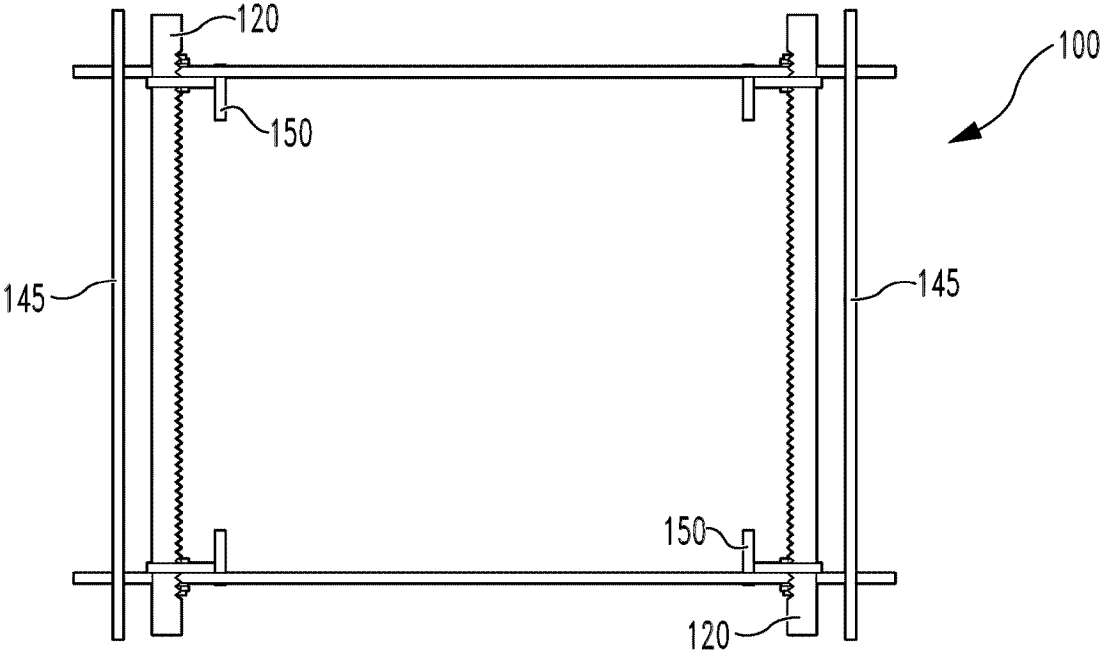
FIG. 3 is a top plan view of the embodiment of FIG. 1.
Figure 5:
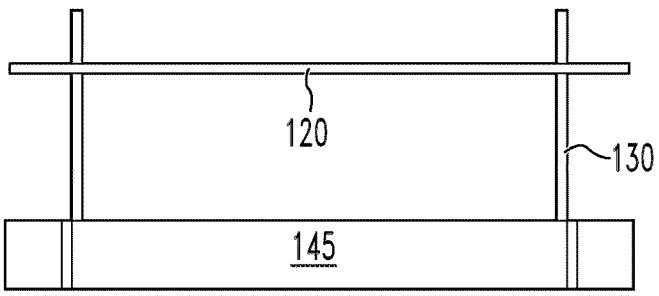
FIG. 5 is a front elevation view of the embodiment of FIG. 1.
Figure 4:
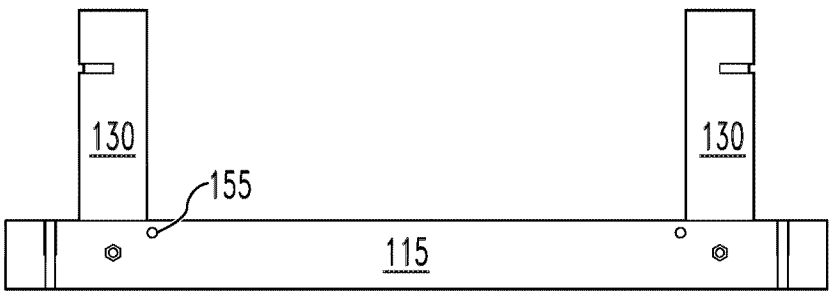
FIG. 4 is a side elevation view of the embodiment of FIG. 1.

FIGS. 1-5 relate to a first embodiment of the present invention, a cake guard system or assembly 100 for covering a cake while allowing the cake to remain visible to guests. The assembly 100 includes a typically generally rectangular elongated frame 105 defined by a first pair of elongated spaced parallel disposed members 115 and a second pair of elongated spaced parallel disposed members 145 lockingly connected thereto, wherein the first elongated members 115 are of a first length and the second elongated members 145 are of a second length typically shorter than the first length. Elongated members 115 are typically notched 125 at either end to lockingly accept the elongated members 145. Elongated member 145 are typically also notched 147, such that members 115 and 145 are connected by lockingly engaging notches 127 and notches 147 together.

Pivotable legs 130 are also connected to elongated members 115, with each elongated member 115 typically having one leg 130 connected by a pivot connection 135 adjacent each notch 125. The legs 130 are likewise notched 140 to receive elongated serrated members 120. Stopping pegs 150 are connected adjacent legs 130 opposite notches 125 to prevent legs 130 from freely rotating about connections 135.

Plastic film 110 is stretched taught between the elongated serrated cross-members 120, and is typically anchored by engaging the serrated cross-members 120 with the serrations 123 (also sometimes referred to as teeth 123). The plastic film 115 is typically transparent to allow a view of a cake positioned therebelow.

Figure 6:
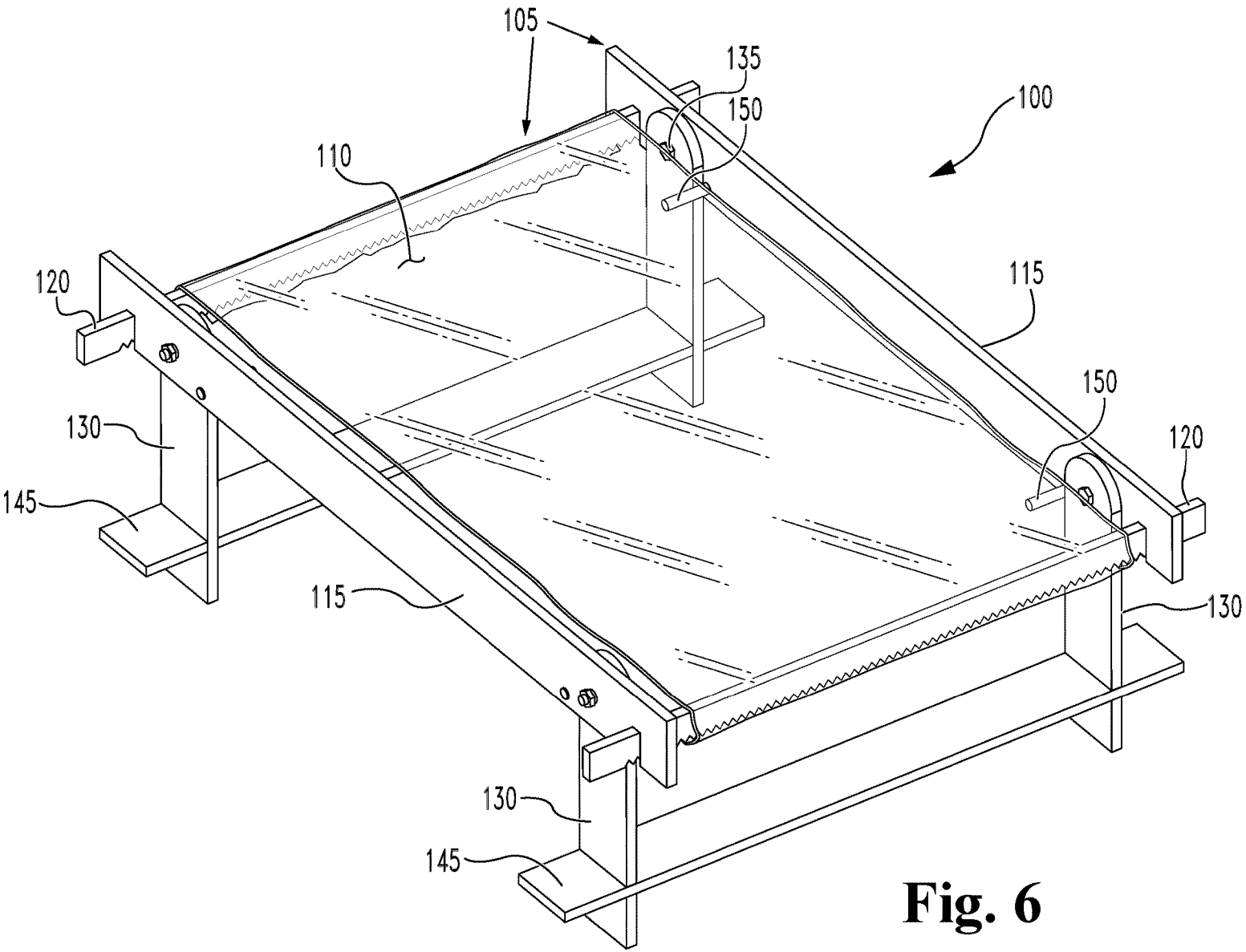
FIG. 6 is a first front perspective view of a second embodiment cake protector assembly of the present invention.
Figure 7:
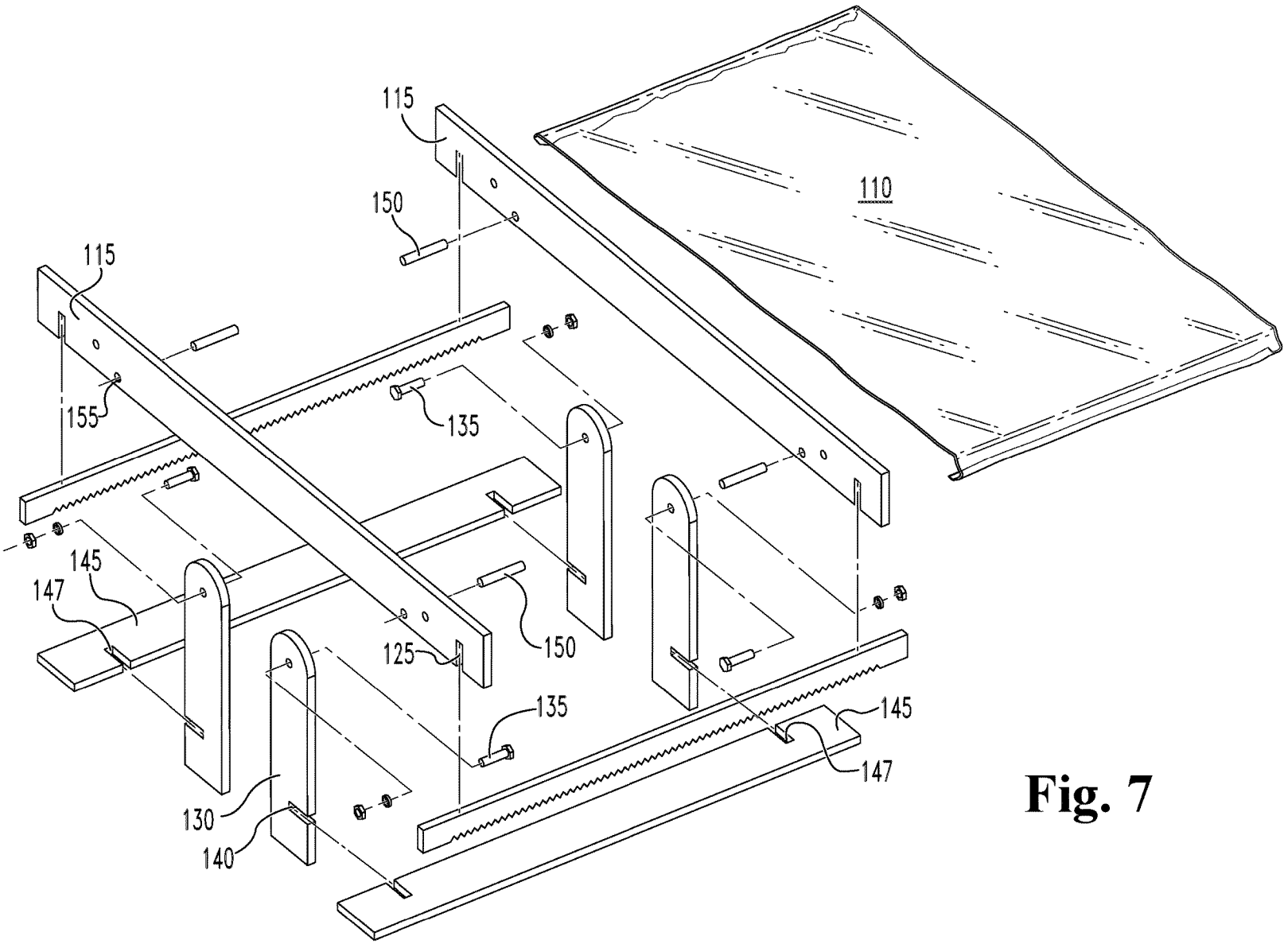
FIG. 7 is a second, exploded front perspective view of the embodiment of FIG. 6.
Figure 8:
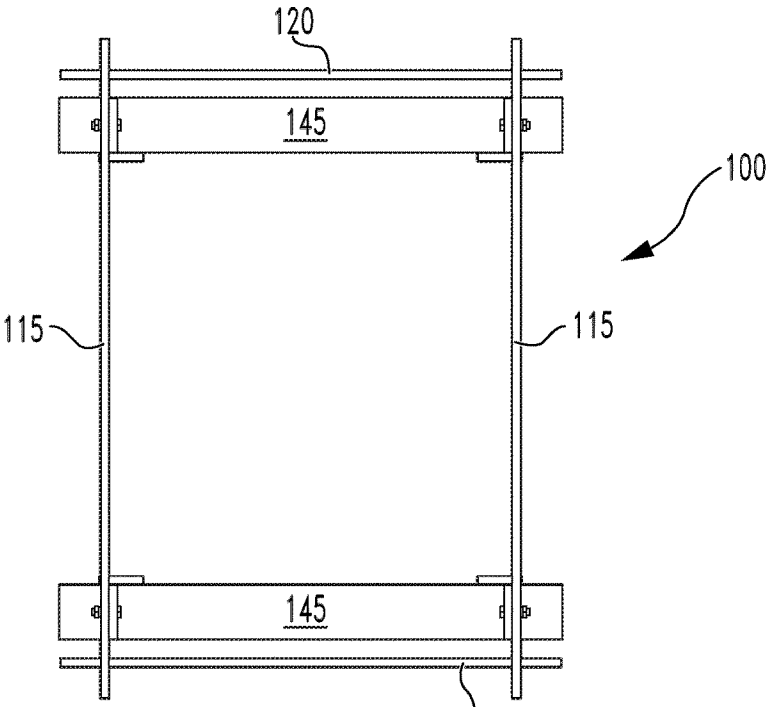
FIG. 8 is a top plan view of the embodiment of FIG. 6.
Figure 9:
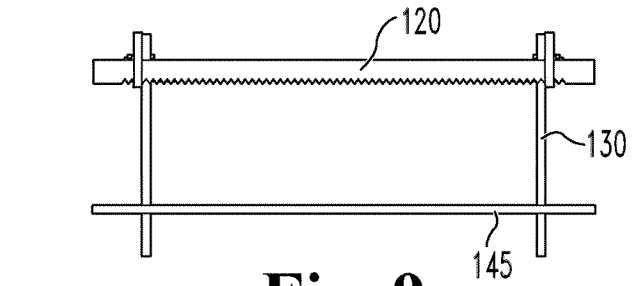
FIG. 9 is a front elevation view of the embodiment of FIG. 6.
Figure 10:
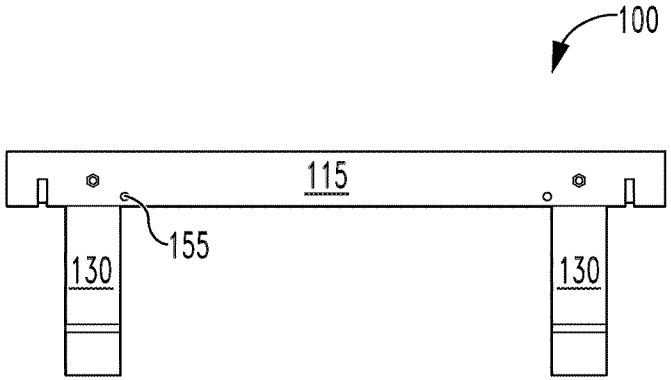
FIG. 10 is a side elevation view of the embodiment of FIG. 6.
Figure 11:
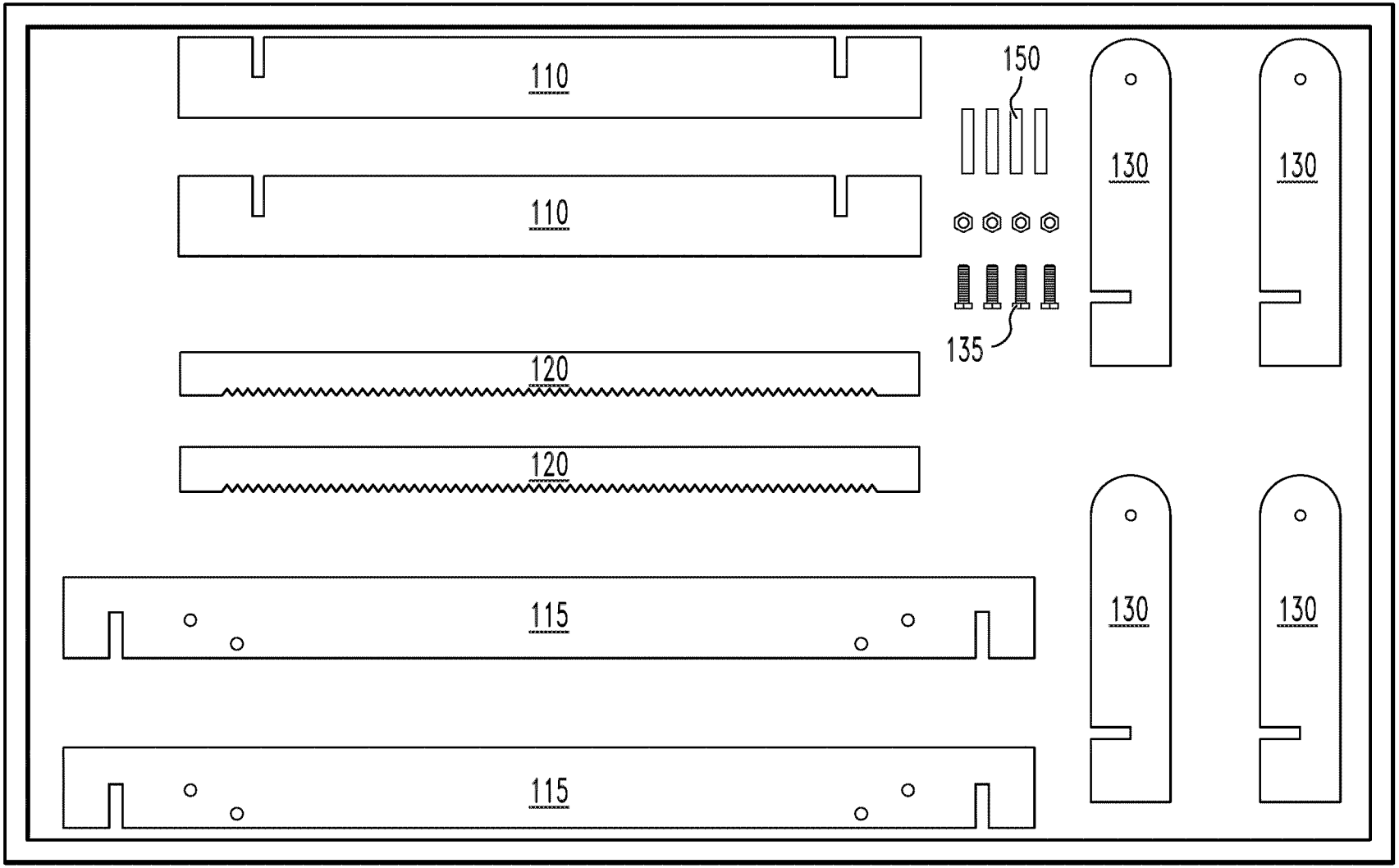
FIG. 11 is a schematic view of a first embodiment kit for building the assembly of FIG. 1
Figure 12:
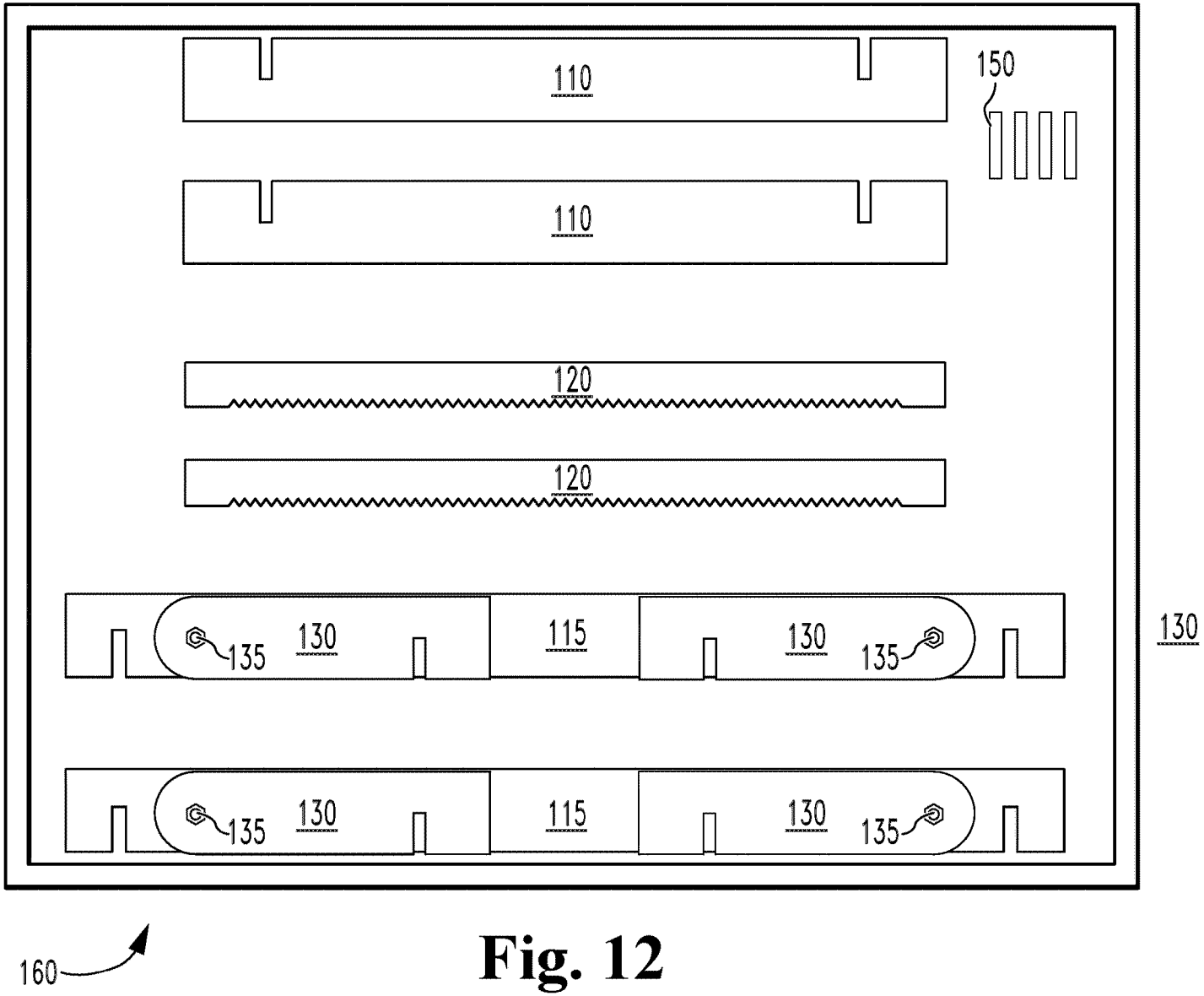
FIG. 12 is a schematic view of a second embodiment kit for building the assembly of FIG. 1

FIGS. 6-10 relate to a second embodiment cake guard system or assembly 100 for covering a cake while allowing the cake to remain visible to guests. The assembly 100 uses the same elements as does the first embodiment described above, but assembled into an alternate configuration. A typically generally rectangular elongated frame 105 supports a top sheet of transparent plastic film 110. The frame 105 includes a working plane defined by a first pair of elongated spaced parallel disposed members 115 and a second pair of elongated spaced parallel disposed members 120 lockingly connected thereto, wherein the first elongated members 115 are of a first length and the second elongated members 120 are of a second length typically shorter than the first length and typically serrated along one edge; the second elongated members may be conveniently referred to as 'semi-elongated' members 120. Elongated members 115 are typically notched 125 at either end to lockingly accept the semi-elongated members 120.

Pivotable legs 130 are also connected to elongated members 115, with each elongated member 115 typically having one leg 130 connected by a pivot connection 135 adjacent each notch 125. The legs 130 are likewise notched 140 to receive elongated support members 145. Typically, support members 145 are also notched 147, enabling notch-notch 140, 147 locking engagement of the two members 130, 145. Stopping pegs 150 are connected adjacent legs 130 opposite notches 125 to prevent legs 130 from freely rotating about connections 135.

The plastic film 110 is stretched taught between the elongated members 115 and anchored by engaging the serrated cross members 120. The plastic film 115 is typically transparent to allow a view of a cake positioned therebelow.

When not in use, the various pieces of the assembly 100 (two elongated members 115, two serrated members 120, four pivotable legs 130, two support members 145, and four pegs 150) are separated and stored, such as in a box or bag, until needed. Typically, the pivotable legs 130 remain connected to the elongated members 115 by the pivot connections 135 (two legs 130 per elongated member 115) and are merely pivoted into parallel orientation with the respective elongated members 115 to which they are connected for ease of storage.

In operation, the various pieces of the assembly 100 as described above are removed from storage for assembly into the protector assembly 100. The elongated members 115 are positioned parallel one another and separated with the notches 125 accessible. Serrated members 120 are engaged with the notches 125 with the serrations dispose opposite the notches 125, and the serrated members 125 are disposed parallel with one another and orthogonal to the elongated members 115. The legs 130 are pivoted away from the elongated members 115 and oriented perpendicular thereto. Pegs 150 are engaged with apertures 155 in the elongated members 115 to prevent further pivoting of the legs 130. Support members 145 are engaged with eh notches 140 in the legs 130, with each support member 145 extending between two legs 130 and oriented parallel to the serrated members 120. Film 110 is extended between the separated elongated members 115 and anchored through engagement with the serrated members 120. Assembly 100 is then positioned over a cake such that the cake is visible therebelow through the film 110. The guard assembly 100 may be removed to access the cake, or the plastic film 110 may be completely or partially removed to access a portion of the cake.

After the cake has been served or otherwise disposed of, the guard assembly 100 may be disassembled down to its component parts 115, 120, 130, 145, 150, by essentially reversing the above assembly steps.

The assembly components 115, 120, 130, 145, 150 may be provided and/or stored as a kit 160. The kit 160 may include a length or roll of plastic film 110, or the film 110 may be provided separately by the user.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A cake protector assembly, comprising:

a first pair of spaced, parallel elongated members;

a second pair of spaced, parallel elongated members connected to the first pair of spaced, parallel elongated members using a notched connection to define a parallelogram shaped frame;

a pair of spaced notched leg members pivotably connected to opposing ends of each member of the first pair of spaced, parallel elongated support member; and a pair of spaced elongated stabilizing members, with each elongated stabilizing member positioned in respective notches of the spaced notched leg members such that they are parallel with one another and positioned at opposing ends of the cake protector assembly;

wherein the spaced elongated stabilizing members include a serrated portion engaging opposing ends of a length of a transparent plastic film that spans a distance between the spaced elongated stabilizing members;

wherein the serrated portions are engaged with the notches, with serrations opposite the notches;

wherein the length of the transparent plastic film is stretched taught between the serrated portions.

2. The assembly of claim 1 and further comprising a plurality of pegs connected to each respective first pair of spaced parallel elongated member to limit pivoting of each respective leg member.

3. A kit for constructing a cake protector assembly, comprising:

a first pair of elongated frame members;

a second pair of elongated frame members configured for engagement with the first pair of elongated frame members using a notched connection and in such a manner to form a parallelogram shaped frame;

a pair of leg members pivotably connected to each respective member of the first pair of the elongated frame members at opposing ends thereof;

a pair of serrated elongated stabilizing members connectable to extend orthogonally from leg members using another notched connection such that they are parallel with one another and positioned at opposing ends of the cake protector assembly, wherein the serrated elongated stabilizing members are engaged with the notches, with serrations opposite the notches;

and four pegs connectible to the first pair of elongated frame members for limiting the movement of each respective leg member;

wherein, in an assembled configuration of the kit, a length of transparent plastic film is stretched taught between the serrations of the pair of serrated elongated stabilizing members.

4. A cake protector assembly, comprising:

a first pair of spaced, notched parallel elongated members;

a pair of spaced notched leg members pivotably connected to opposing ends of each member of the first pair of spaced, parallel elongated support member;

wherein the first pair of spaced, notched parallel elongated members and the pair of spaced notched leg members define a parallelogram shaped frame;

a second pair of spaced, parallel elongated members positioned in respective notches of the pair of the spaced notched leg members such that they are orthogonal to the first pair of spaced, notched parallel elongated members and at opposing ends of the cake protection assembly;

a pair of spaced elongated serrated stabilizing members, each respective elongated serrated stabilizing member positioned in respective notches of the first pair of spaced notched parallel elongated members at opposing ends of the cake protection assembly;

wherein the spaced elongated serrated stabilizing members are engaged with the notches, with serrations opposite the notches;

wherein the spaced elongated serrated stabilizing members include the serrations engaging opposing ends of a length of a transparent plastic film;

wherein the length of the transparent plastic film is stretched taught between the serrations of the pair of spaced elongated serrated stabilizing members.

5. The cake protector assembly of claim 4, wherein the first pair of spaced, parallel elongated members and the second pair of spaced, parallel elongated members are held together using a notched engagement.

6. A kit for constructing a cake protector assembly, comprising:

a first pair of elongated notched frame members;

a pair of notched leg members pivotably connected to each respective member of the first pair of the elongated frame members at opposing ends thereof;

wherein the first pair of notched frame members and the pair of notched leg members are connectable to define a parallelogram shaped frame;

a second pair of elongated frame members connectable with the notches of the pair of spaced notched leg members such that they are orthogonal to the first pair of spaced, notched parallel elongated members and at opposing ends of the cake protection assembly;

a pair of serrated elongated stabilizing members connectable to extend orthogonally from the notched leg members such that they are parallel with one another and positioned at opposing ends of the cake protector assembly; and four pegs connectible to the first pair of elongated frame members for limiting the movement of each respective leg member;

wherein serrations of the pair of serrated elongated stabilizing members are engaged with the notches, with the serrations opposite the notches;

wherein a length of transparent plastic film is stretched taught between the serrations of the pair of serrated elongated stabilizing members.

7. The kit of claim 6 and further comprising a length of transparent plastic film connectible to each serrated elongated stabilizing member for disposition in a working plane.

* * * * *